US011638976B2

(12) United States Patent
Ebina et al.

(10) Patent No.: US 11,638,976 B2
(45) Date of Patent: May 2, 2023

(54) OSCILLATING DEVICE, SUPERFINISHING DEVICE, METHOD OF MANUFACTURING BEARING, METHOD OF MANUFACTURING VEHICLE, AND METHOD OF MANUFACTURING MACHINE

(71) Applicant: NSK LTD., Tokyo (JP)

(72) Inventors: Takeshi Ebina, Fujisawa (JP); Kengou Mizuura, Fujisawa (JP)

(73) Assignee: NSK LTD., Tokyo (JP)

( * ) Notice: Subject to any disclaimer, the term of this patent is extended or adjusted under 35 U.S.C. 154(b) by 515 days.

(21) Appl. No.: 16/625,524

(22) PCT Filed: Apr. 23, 2018

(86) PCT No.: PCT/JP2018/016507
§ 371 (c)(1),
(2) Date: Dec. 20, 2019

(87) PCT Pub. No.: WO2019/003611
PCT Pub. Date: Jan. 3, 2019

(65) Prior Publication Data

US 2021/0308821 A1 Oct. 7, 2021

(30) Foreign Application Priority Data

Jun. 29, 2017 (JP) ..... JP2017-127207
Nov. 9, 2017 (JP) ..... JP2017-216414

(51) Int. Cl.
*B24B 19/06* (2006.01)
*B24B 47/12* (2006.01)

(52) U.S. Cl.
CPC ..... *B24B 19/06* (2013.01); *B24B 47/12* (2013.01)

(58) Field of Classification Search
CPC ..... B24B 19/06; B24B 47/12; B24B 35/00
See application file for complete search history.

(56) References Cited

U.S. PATENT DOCUMENTS 3,986,302 A * 10/1976 Biardi ..... B24B 45/00 451/342
9,289,882 B2 * 3/2016 Kaneko ..... B24B 23/03
2001/0034170 A1 10/2001 Keese
(Continued)

FOREIGN PATENT DOCUMENTS

CN 103286669 A 9/2013
CN 104441723 A 3/2015
(Continued)

OTHER PUBLICATIONS

Machine Translation of Gunnewijk, EP829237A2, Mar. 18, 1998 (Year: 1998).*
(Continued)

*Primary Examiner* — Ryan J. Walters
(74) *Attorney, Agent, or Firm* — Sughrue Mion, PLLC

(57) ABSTRACT

An oscillating device includes: a driving source; an oscillating member which performs an oscillating motion; and a connecting mechanism which converts a rotational motion of the driving source into an oscillating motion and transmits the oscillating motion to the oscillating member. At least one of a part or whole of a component forming the connecting mechanism is a component made of a fiber-reinforced resin, and the component made of a fiber-reinforced resin includes a reinforced fiber and a binder resin.

19 Claims, 17 Drawing Sheets

(56) References Cited

U.S. PATENT DOCUMENTS

| | | | |
|---|---|---|---|
| 2004/0159420 | A1 | 8/2004 | Goupil, Jr. et al. |
| 2005/0170722 | A1 | 8/2005 | Keese |
| 2005/0282023 | A1 | 12/2005 | Comeaux et al. |
| 2021/0308821 | A1 | 10/2021 | Ebina et al. |

FOREIGN PATENT DOCUMENTS

| | | | |
|---|---|---|---|
| EP | 0829237 | A2 | 3/1998 |
| JP | 60-118487 | A | 6/1985 |
| JP | 62-210208 | A | 9/1987 |
| JP | 1-249325 | A | 10/1989 |
| JP | 2006-510548 | A | 3/2006 |
| JP | 2006-255889 | A | 9/2006 |
| JP | 2007-271079 | A | 10/2007 |
| JP | 2007-332688 | A | 12/2007 |
| JP | 2010-179386 | A | 8/2010 |
| JP | 2013-91252 | A | 5/2013 |
| JP | 2013-173201 | A | 9/2013 |
| JP | 2014-14883 | A | 1/2014 |
| JP | 6455643 | B1 | 1/2019 |
| JP | 6531862 | B2 | 6/2019 |
| JP | 6597926 | B2 | 10/2019 |

OTHER PUBLICATIONS

Written Opinion dated Jun. 26, 2018, issued in the International Searching Authority in counterpart International Patent Application No. PCT/JP2018/016507 (PCT/ISA/237).

Search Report dated Jun. 26, 2018, issued in the International Searching Authority in counterpart International Patent Application No. PCT/JP2018/016507 (PCT/ISA/210).

Communication dated Feb. 5, 2019, issued by the Japanese Patent Office in counterpart Japanese Patent Application No. 2018-206636.

Communication dated Jun. 18, 2019, issued by the Japanese Patent Office in counterpart Japanese Patent Application No. 2019-094543.

Communication dated Nov. 4, 2019, issued by the European Patent Office in counterpart European Patent Application No. 18205104.5.

Office Action dated Sep. 1, 2021 by the State Intellectual Property Office of P.R. China in counterpart Chinese Patent Application No. 201811330356.6.

Communication dated Apr. 11, 2019, issued by the European Patent Office in counterpart European Patent Application No. 18205104.5.

Communication dated Oct. 25, 2022 issued by the Japanese Patent Office in counterpart Japanese Patent Application No. 2019-166696.

* cited by examiner

OSCILLATING DEVICE, SUPERFINISHING DEVICE, METHOD OF MANUFACTURING BEARING, METHOD OF MANUFACTURING VEHICLE, AND METHOD OF MANUFACTURING MACHINE

TECHNICAL FIELD

The present invention relates to an oscillating device and a superfinishing device provided with the oscillating device. Further, the present invention relates to a method of manufacturing a bearing using the superfinishing device, and a method of manufacturing a vehicle and a machine using the bearing manufactured by the manufacturing method.

BACKGROUND ART

For example, in a superfinishing process of an inner ring raceway surface or an outer ring raceway surface of a bearing, while pressing a grindstone against the inner ring raceway surface or the outer ring raceway surface, the grindstone is oscillated and simultaneously the inner ring or the outer ring is rotated.

Such a process relating to a grindstone is performed using a superfinishing device provided with an oscillating device. FIG. 14 is a perspective view illustrating a superfinishing device described in PTL 1. In the superfinishing device illustrated in the drawing, rotation of a motor 101 is transmitted to an intermediate shaft 103 through a belt 102. A crank 106 is connected to the intermediate shaft 103 through an eccentric pin 105, and an eccentric motion of the crank 106 is transmitted to a grindstone spindle 107, thereby oscillating a grindstone 110 mounted on a tip arm 108 of the grindstone spindle 107. The grindstone 110 is pressed against an inner ring raceway surface of an inner ring 111 to superfinish the inner ring raceway surface by oscillating the grindstone 110 while rotating the inner ring 111. Further, a device for oscillating the grindstone 110 is referred to as the oscillating device.

CITATION LIST

Patent Literature

[PTL 1] JP-A 2006-255889

SUMMARY OF INVENTION

Technical Problem

The superfinishing process of an inner ring raceway surface and an outer ring raceway surface is important for improving rotation performance of a bearing and takes a considerable time. Therefore, in order to improve production efficiency of the bearing, it is necessary to shorten a process time by increasing a speed of an oscillating device for oscillating a grindstone. For increasing the speed, it is necessary to reduce weights of components of the oscillating device, so that reduction in the weights of the components has been facilitated in the related art by using an aluminum alloy and the like. However, further weight reduction is strongly desired.

Accordingly, an object of the present invention is to shorten a process time by further reducing weights of respective components such as a connecting rod and the like forming a connecting mechanism of an oscillating device to be incorporated in a superfinishing device to improve production efficiency of a bearing.

Solution to Problem

In order to solve the above-mentioned problems, the present invention provides an oscillating device, a superfinishing device, a method of manufacturing a bearing, a method of manufacturing a vehicle, and a method of manufacturing a machine as follows.

(1) An oscillating device includes:

a driving source;

an oscillating member which performs an oscillating motion; and a connecting mechanism which converts a rotational motion of the driving source into an oscillating motion and transmits the oscillating motion to the oscillating member, in which at least one of a part or whole of a component forming the connecting mechanism is a component made of a fiber-reinforced resin, and the component made of a fiber-reinforced resin includes a reinforced fiber and a binder resin.

(2) The oscillating device according to (1), in which the component made of a fiber-reinforced resin includes a hollow portion made of a fiber-reinforced resin.

(3) The oscillating device according to (2), in which the hollow portion is a tubular body formed by binding a wound material of a filament of the reinforced fiber with the binder resin.

(4) The oscillating device according to (1), in which the component made of a fiber-reinforced resin is an assembly in which plate materials made of a fiber-reinforced resin are combined and bonded to each other.

(5) The oscillating device according to (4), in which the plate material is a plate material in which the reinforced fiber is radially oriented outward form a center of a surface thereof.

(6) The oscillating device according to (1), in which the connecting mechanism includes a component comprising:

a first through hole for inserting a shaft eccentric to a rotary shaft of the driving source therethrough, and a second through hole for connecting other components forming the connecting mechanism thereto through another shaft;

the component is formed by binding a wound material of the reinforced fiber with the binder resin, blocks made of the fiber-reinforced resin are inserted into openings at opposite ends of the tubular body to close the openings; and the first through hole and the second through hole are formed to penetrate through the tubular body and the blocks.

(7) The oscillating device according to (6), in which the block is a laminated body formed of thin plates made of a fiber-reinforced resin, and the through hole is formed in a direction orthogonal to a lamination direction.

(8) The oscillating device according to (1), in which the connecting mechanism includes a holding component for holding the oscillating member, and the holding component is an assembly in which plate materials made of the fiber-reinforced resin are bonded to each other.

(9) The oscillating device according to (1), in which the connecting mechanism includes a holding component for holding the oscillating member, and a part or whole of a component forming the holding component is a tubular body formed by binding a wound material of a filament of the reinforced fiber with the binder resin.

(10) The oscillating device according to (1), in which at least a portion where the filament of the reinforced fiber is exposed includes a coating layer made of a silicone resin.

(11) The oscillating device according to (1), in which the connecting mechanism includes a component provided with a tubular body made of a fiber-reinforced resin, a block made of a fiber-reinforced resin is inserted into an opening of the tubular body, and a surface orthogonal to a thickness direction of a thin plate made of a fiber-reinforced resin is arranged in an end surface of the tubular body whose opening is closed by inserting the block.

(12) The oscillating device according to claim 1, in which the connecting mechanism includes a component provided with a tubular body made of a fiber-reinforced resin, blocks made of a fiber-reinforced resin are respectively inserted into opposite ends of the tubular body, and a space between the blocks inside the tubular body is hollow.

(13) The oscillating device according to claim 1, in which the connecting mechanism includes a component provided with a tubular body made of a fiber-reinforced resin, a block formed by laminating a thin plate made of the fiber-reinforced resin is inserted into the tubular body, and a lamination direction of the thin plates and an inserting direction of the blocks into the tubular body are the same.

(14) The oscillating device according to any one of (11) to (13), in which a through hole penetrating through the tubular body and the block is formed.

(15) The oscillating device according to (1), in which the connecting mechanism includes a component provided with a tubular body made of a fiber-reinforced resin, a block made of the fiber-reinforced resin is inserted into the tubular body, a through hole penetrating through the tubular body and the block is formed, and the block is a laminated body formed of thin plates made of a fiber-reinforced resin, and the through hole is formed in a direction orthogonal to a lamination direction of the thin plates.

(16) The oscillating device according to (13), in which a cross section of the tubular body orthogonal to an axial line of the tubular body is a rectangular shape, and the tubular body has a symmetrical shape in a longitudinal direction.

(17) The oscillating device according to (14), in which a metallic sleeve is inserted into the through hole.

(18) The oscillating device according to (1), in which the connecting mechanism includes a component provided with a tubular body made of a fiber-reinforced resin, blocks made of a fiber-reinforced resin are respectively inserted into openings at opposite ends of the tubular body, through holes penetrating through the tubular body and the blocks are formed, and surfaces orthogonal to a thickness direction of thin plates made of a fiber-reinforced resin are arranged in opposite end surfaces of the tubular body whose openings are closed by inserting the block.

(19) A superfinishing device includes the oscillating device according to (1).

(20) A method of manufacturing a bearing includes polishing a raceway surface using the superfinishing device according to (19).

(21) A method of manufacturing a vehicle includes manufacturing a bearing by the method of manufacturing the bearing according to (20).

(22) A method of manufacturing a machine includes manufacturing a bearing by the method of manufacturing the bearing according to (20).

Advantageous Effects of Invention

According to the present invention, a part or whole of the connecting rod forming the connecting mechanism of the oscillating device used for the superfinishing device, and the like is made of a fiber-reinforced resin, thereby making it possible to achieve significant weight reduction in comparison with the case of a metallic rod in the related art. Therefore, it is possible to increase a speed of the oscillating device and further the superfinishing device, thereby dramatically improving production efficiency.

Further, when increasing the speed thereof, vibration and noise are reduced in comparison with the case of the metallic rod, thereby having an advantage of improving a working environment.

DESCRIPTION OF EMBODIMENTS

Hereinafter, the present invention will be described in detail with reference to the drawings.

Figure 1:
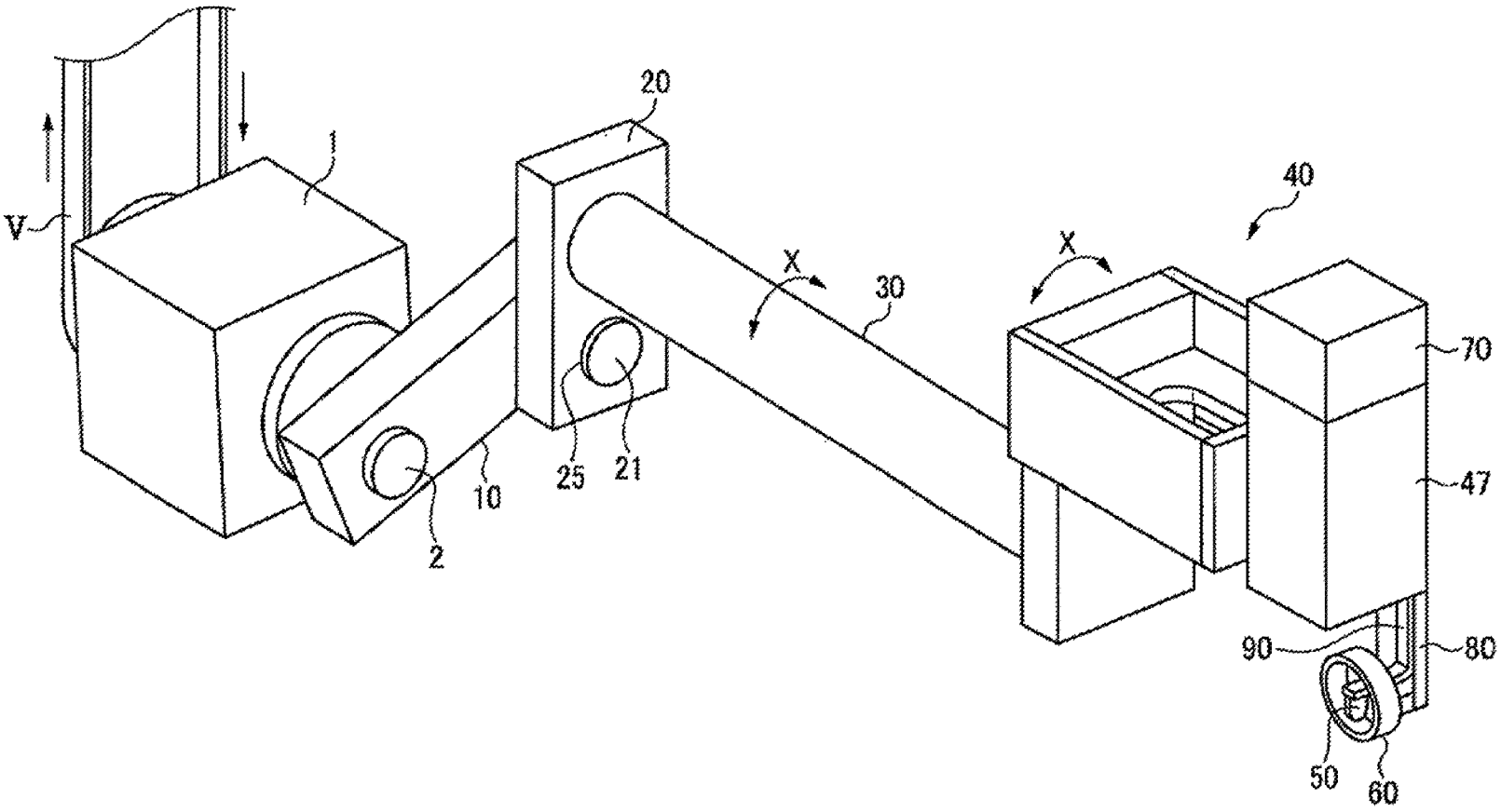
FIG. 1 is a perspective view illustrating one example of an oscillating device.

FIG. 1 is a perspective view illustrating one example of an oscillating device, and the oscillating device forms a part of a superfinishing device. The oscillating device illustrated in the drawing includes a motor not illustrated in the drawing and serving as a driving source, an intermediate shaft spindle 1, a connecting rod 10, a connecting arm 20, a connecting shaft 30, a grindstone holder 40, and a pressurizing cylinder 47 mounted on the grindstone holder 40.

Figure 2:
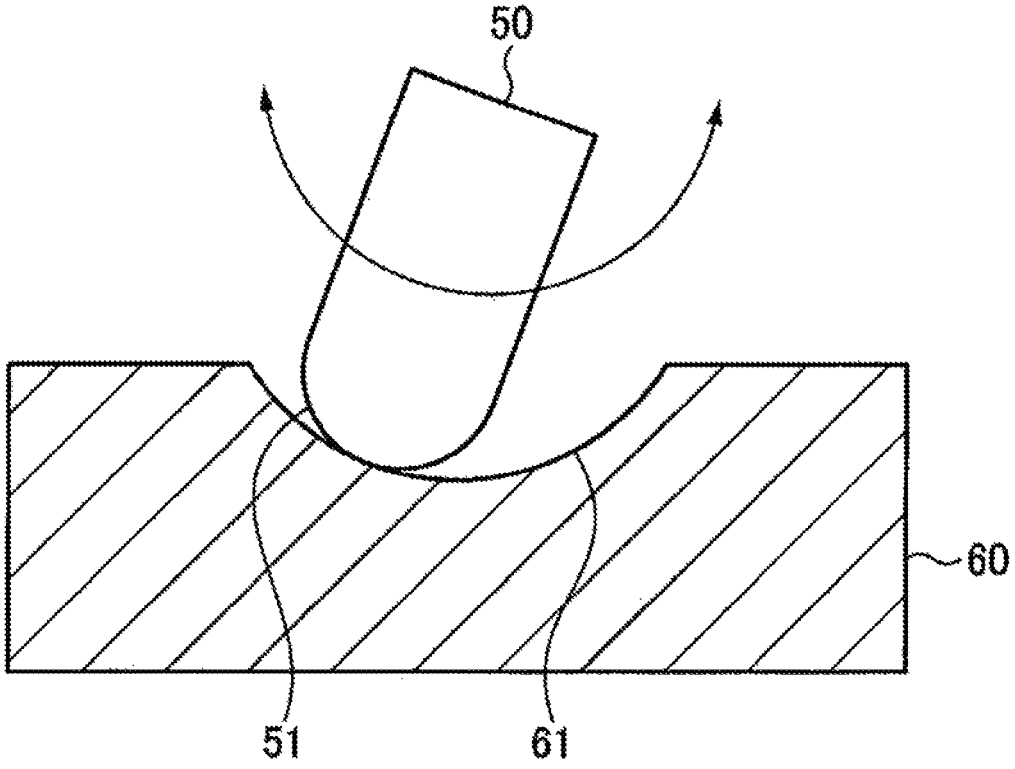
FIG. 2 is a view for describing an oscillatory motion of a grindstone.

Further, a grindstone 50 is mounted on the grindstone holder 40, and the grindstone 50 and a device for oscillating the grindstone 50 while pressing the grindstone against a workpiece (in this case, an outer ring raceway surface of an outer ring 60) to be processed and are called as a superfinishing device. As illustrated in FIG. 2, a tip 51 of the grindstone 50 is pressed against an outer ring raceway surface 61 of the outer ring 60, and this pressing is performed in such a manner that a lower end part (not illustrated) of a pressurizing member mounted on the pressurizing cylinder 47 presses a pressurizing lever 90 held in a pressurizing lever holder 80 downward in the drawing, and an upper end of the grindstone 50 is pressed by a tip of the pressurizing lever 90. The grindstone 50 is oscillated in an X direction in FIG. 1 by the oscillating device which will be described later. Then, while the tip 51 is pressed against the outer ring raceway surface 61, a reciprocating motion is performed to the right and left in the drawing in a circular arc shape along a groove shape of the outer ring raceway surface 61. On the other hand, the outer ring 60 rotates in a circumferential direction, and the outer ring raceway surface 61 is polished by the oscillating grindstone 50.

When describing respective components forming the oscillating device in detail, the rotation from the motor as the driving source is transmitted to the intermediate shaft spindle 1 through a belt V. The connecting rod 10 for performing an eccentric motion with a rotary shaft of the intermediate shaft spindle 1 is mounted on the intermediate shaft spindle through a shaft 2. As illustrated in FIGS. 3A to 5C, the connecting rod 10 includes a first through hole 11 for inserting the shaft 2 and a second through hole 12 for inserting a shaft 21 for being connected to a connecting arm 20, and bearings (not illustrated) are inserted into the respective through holes 11 and 12.

The shaft 21 for being connected to the connecting rod 10 is inserted into a through hole 25 in the connecting arm 20. Further, the connecting shaft 30 is mounted on the connecting arm 20 so as to extend to a side of the grindstone holder 40 in parallel with the shaft 21. Additionally, the grindstone holder 40 is mounted on a tip of the connecting shaft 30.

Then, the connecting rod 10 performs the eccentric motion with respect to an axis of the intermediate shaft spindle 1 by the rotation of the motor, and the shaft 21 of the connecting arm 20 connected to the connecting rod 10 oscillates around an axial line of the connecting shaft 30. Therefore, the connecting shaft 30 is reciprocally rotated centering on the axial line at a predetermined angle in the X direction illustrated in the drawing. The grindstone holder 40 is also reciprocally rotated in the same direction in accordance with the reciprocating rotation of the connecting shaft 30, and the grindstone 50 is finally reciprocated in the same direction, thereby performing oscillation as illustrated in FIG. 2.

In the present invention, a portion formed by the connecting rod 10, the connecting arm 20, the connecting shaft 30, and the grindstone holder 40 is referred to as a "connecting mechanism". Then, at least one, and desirably, all of the connecting rod 10, the connecting arm 20, the connecting shaft 30, and the grindstone holder 40 forming the connecting mechanism is made of a fiber-reinforced resin including a reinforced fiber and a binder resin. Even though these components have been made of metal so far, it is possible to dramatically achieve weight reduction by the components made of the fiber-reinforced resin, thereby making it possible to drive at a high speed. Further, even though the driving is performed at the high speed, vibration, noise, and the like are lower than those made of metal, thereby greatly improving a working environment.

Further, it is desirable that all of these components are made of the fiber-reinforced resin, however, in consideration of strength, it is also possible to change a part of the components to another material such as metal, and the like. Additionally, a ratio between a portion made of the fiber-reinforced resin and a portion made of another material is arbitrary, and the ratio therebetween is appropriately set in consideration of the weight reduction and the strength according to the parts.

Particularly, the high speed of the connecting rod 10 leads to the high speed of the oscillation of the grindstone holder 40, thereby increasing an effect of the weight reduction. Further, even in the superfinishing device provided with the oscillating device, an oscillating motion of the grindstone 50 can be performed with the high speed, thereby contributing to shortening a process time.

Figure 3A:
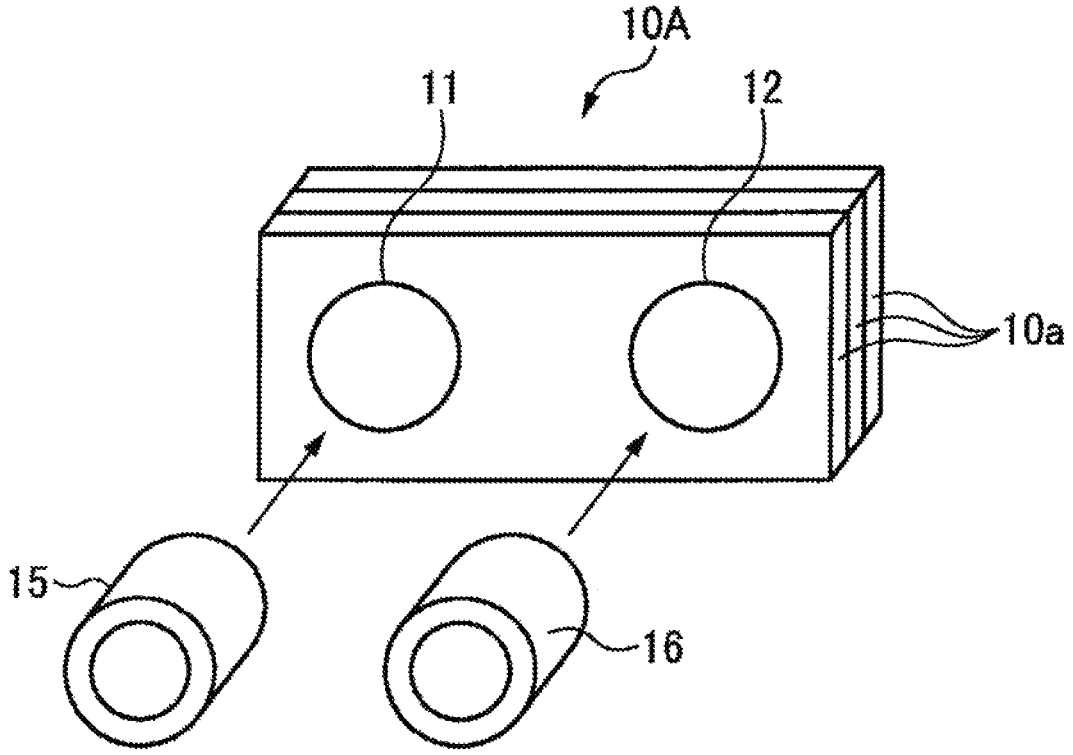
FIG. 3A is a perspective view illustrating a connecting rod formed by laminating thin plates made of a fiber-reinforced resin and FIG. 3B is a schematic view for describing an orientation direction of a reinforced fiber.
Figure 3B:
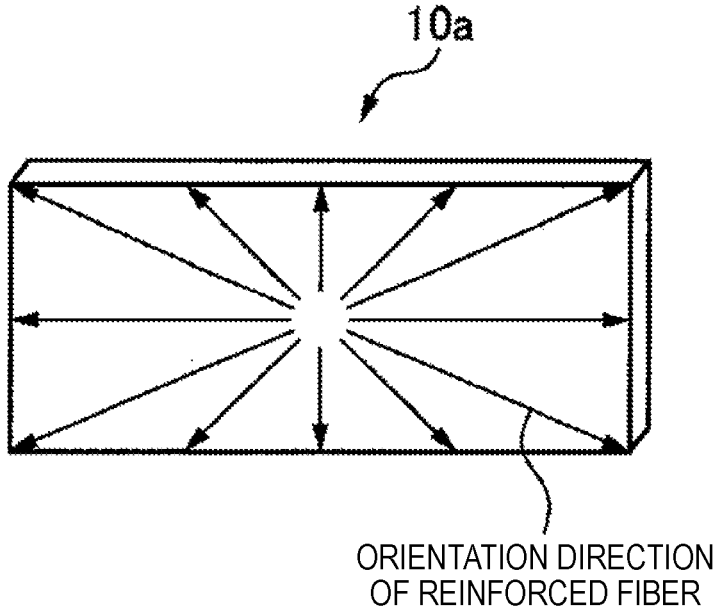
Figure 4:
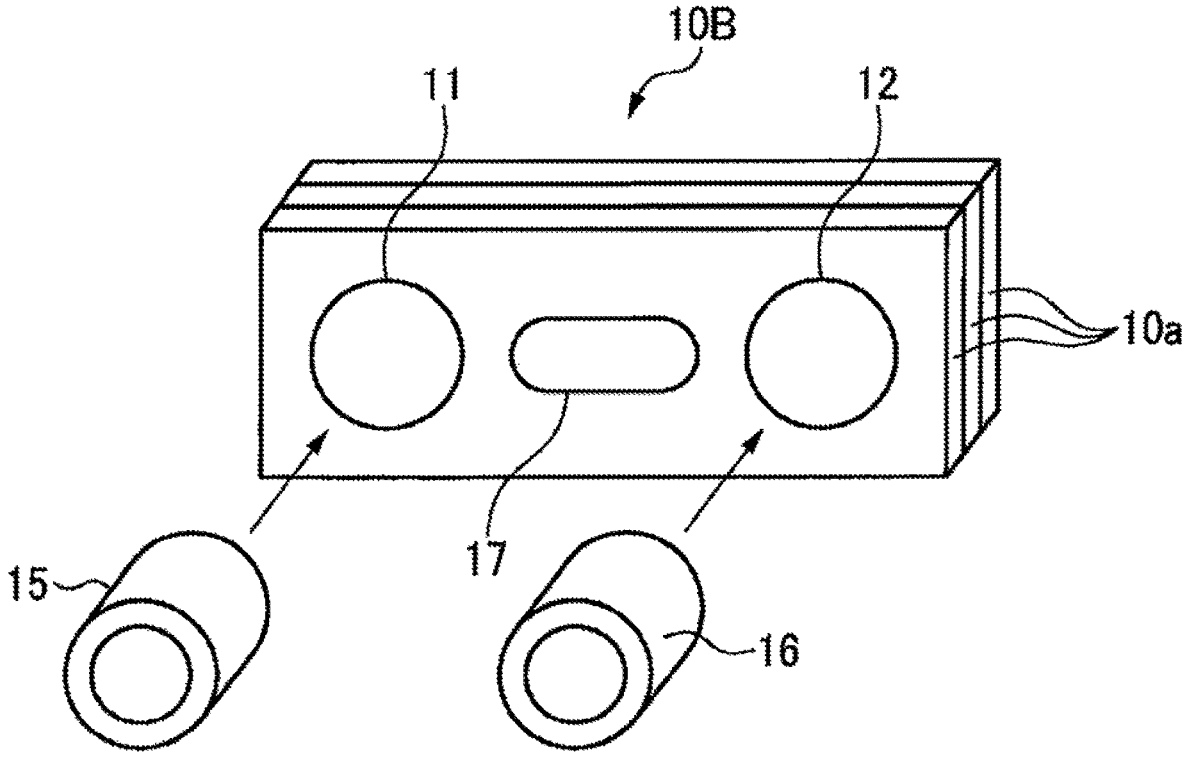
FIG. 4 is a view in which a cavity is formed in the connecting rod of FIGS. 3A and 3B.
Figure 5A:
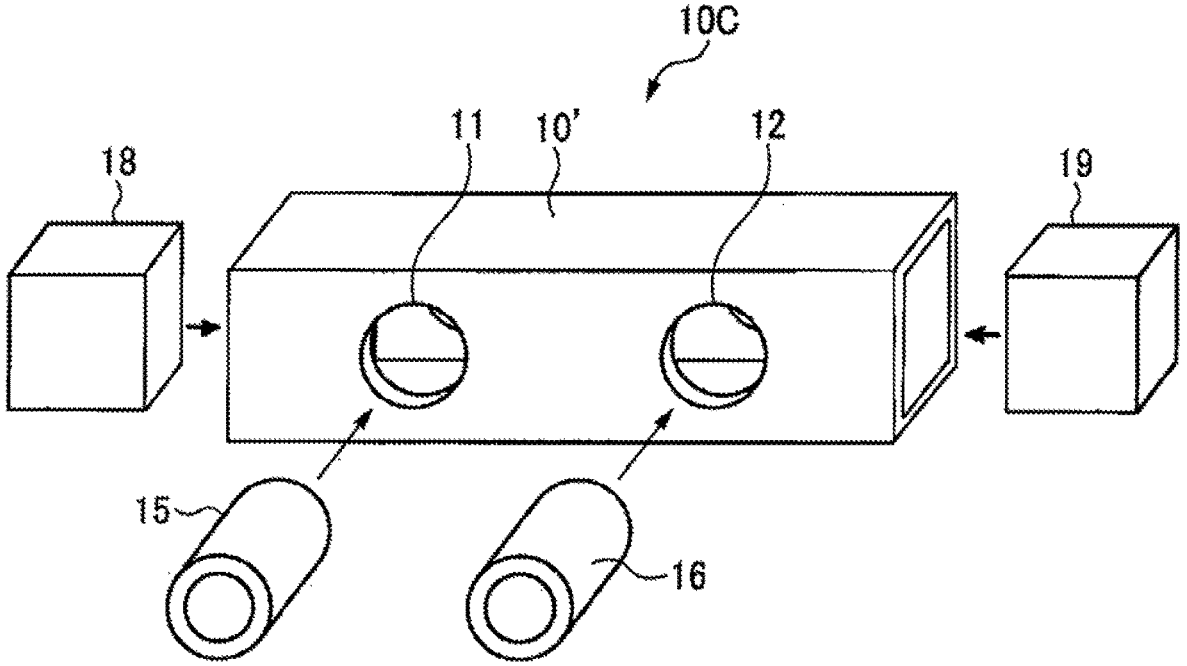
FIG. 5A is an exploded perspective view illustrating the connecting rod provided with a rectangular tubular part made of a fiber-reinforced resin.

A case where the connecting rod 10 is made of the fiber-reinforced resin will be described with reference to FIGS. 3A to 5C. For the convenience of description, a connecting rod illustrated in FIGS. 3A and 3B is defined as 10A, a connecting rod illustrated in FIG. 4 is defined as 10B, and a connecting rod illustrated in FIG. 5A is defined as 10C. Further, in the connecting rods 10A to 10C, sleeves 15 and 16 made of metal such as aluminum, and the like are fitted thereinto and integrated therewith in order to fit bearings (not illustrated) into the first through hole 11 for being connected to the intermediate shaft spindle 1 and the second through hole 12 for being connected to the connecting arm 20. It is possible to improve the smoothness of the surface by forming the sleeves 15 and 16 with a metallic surface rather than forming inner peripheral surfaces of the first and second through holes 11 and 12 as the surfaces of the fiber-reinforced resin. Further, since an outer ring of the bearing is press-fitted, the metallic sleeves 15 and 16 are more superior in strength.

The connecting rod 10A illustrated in FIG. 3A has a configuration in which a plurality of thin plates 10*a* made of the fiber-reinforced resin are laminated; the thin plates are bonded to each other to form a prismatic column having a predetermined thickness; and the first through hole 11 and the second through hole 12 are opened, whereby the sleeves 15 and 16 are inserted thereinto. Even though an orientation direction of the reinforced fiber is schematically illustrated in FIG. 3B, it is desirable to orient the reinforced fiber radially outward from a center of the surface in consideration of strength. In this oriented state, the reinforced fiber is oriented in a radial direction of the through holes 11 and 12.

In addition to radially orienting the reinforced fiber, the thin plates 10*a* in which the reinforced fibers are oriented in one direction may be laminated by being intersected with each other at upper and lower layers at a predetermined angle (for example, 45° or) 90°.

Further, even in the descriptions hereinafter, it is desirable that the orientation direction of the reinforced fiber in the thin plate 10*a* made of the fiber-reinforced resin is the orientation illustrated in FIG. 3B.

A weight of the connecting rod 10A made of the fiber-reinforced resin can be about 40% reduced in comparison with that of a connecting rod made of aluminum of the same shape.

The connecting rod 10B illustrated in FIG. 4 is formed by providing a cavity 17 between the through holes 11 and 12 with respect to the connecting rod 10A illustrated in FIG. 3A, thereby further achieving weight reduction by the extent of the cavity 17. Further, an opening area of the cavity 17, the number thereof, and a formation position thereof are appropriately set in consideration of the strength of the connecting rod 10B.

Figure 5B:
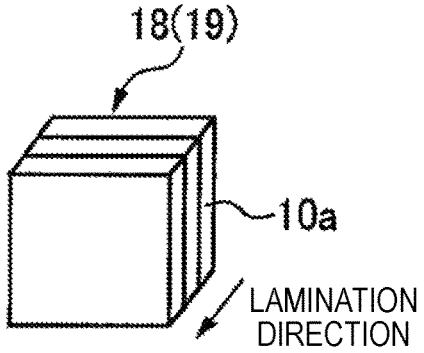
FIGS. 5B and 5C are schematic views for describing a lamination style of thin plates in a block.
Figure 5C:
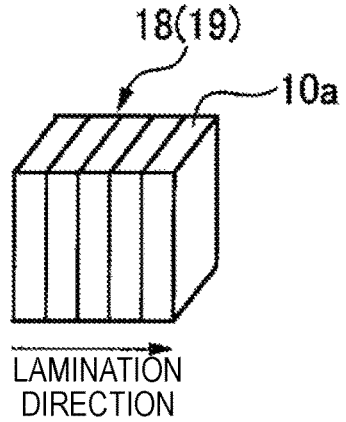

The connecting rod 10C illustrated in FIG. 5A has a configuration in which blocks 18 and 19 made of the fiber-reinforced resin are inserted into openings at opposite ends of a rectangular tubular part 10' in which the first through hole 11 and the second through hole 12 are opened, thereby closing the openings thereof. The rectangular tubular part 10' is formed by boring the first through hole 11 and the second through hole 12 in a wound material around which a thin plate made of the fiber-reinforced resin is wound. Further, a configuration of the rectangular tubular part 10' is not limited thereto, for example, a filament made of a reinforced fiber which is impregnated with the binder resin is wound a number of times along a longitudinal direction of a prism-shaped core material, and the binder resin is cured, after which the core material is pulled out and molded, and the first through hole 11 and the second through hole 12 may be bored. The blocks 18 and 19 made of the fiber-reinforced resin are members formed in block shapes by laminating the thin plates made of the fiber-reinforced resin. In the connecting rod 10C, the rectangular tubular part 10' made of the fiber-reinforced resin is hollow, and the weight can be further reduced in comparison with the connecting rod 10B illustrated in FIG. 4. Further, the rectangular tubular part 10' is reinforced by the blocks 18 and 19, thereby having no problem in consideration of the strength. Further, the blocks 18 and 19 are laminated with the thin plates 10*a*, and a form of laminating the thin plates 10*a* in an inserting direction of the blocks 18 and 19 as illustrated in FIG. 5C is more desirable than a form of laminating the thin plates 10*a* in a direction orthogonal to the inserting direction of the blocks 18 and 19 as illustrated in FIG. 5B. In the case of a lamination style illustrated in FIG. 5B, when the openings of the connecting rod 10C are closed with the blocks 18 and 19, end surfaces of the connecting rod 10 are laminated surfaces of the thin plates 10*a*. On the other hand, in the case of a lamination style illustrated in FIG. 5C, end surfaces of the connecting rod 10 are surfaces of the thin plates 10*a*. In the superfinishing device provided with the oscillating device, cooling water and processing oil are often applied to the device, and the thin plate 10*a* made of the fiber-reinforced resin results in swelling caused by water absorption and oil absorption at a thickness portion (end surface) where the reinforced fiber is exposed. Therefore, when laminated surfaces of the blocks 18 and 19 are exposed to the end surfaces of the connecting rod 10C as illustrated in FIG. 5B, the end surfaces thereof swell. On the other hand, in FIG. 5C, the end surfaces of the connecting rod 10C are the surfaces of the thin plates 10*a*, and since the laminated surface is surrounded by the rectangular tubular part 10', the swelling of the blocks 18 and 19 can be suppressed.

Figure 6A:
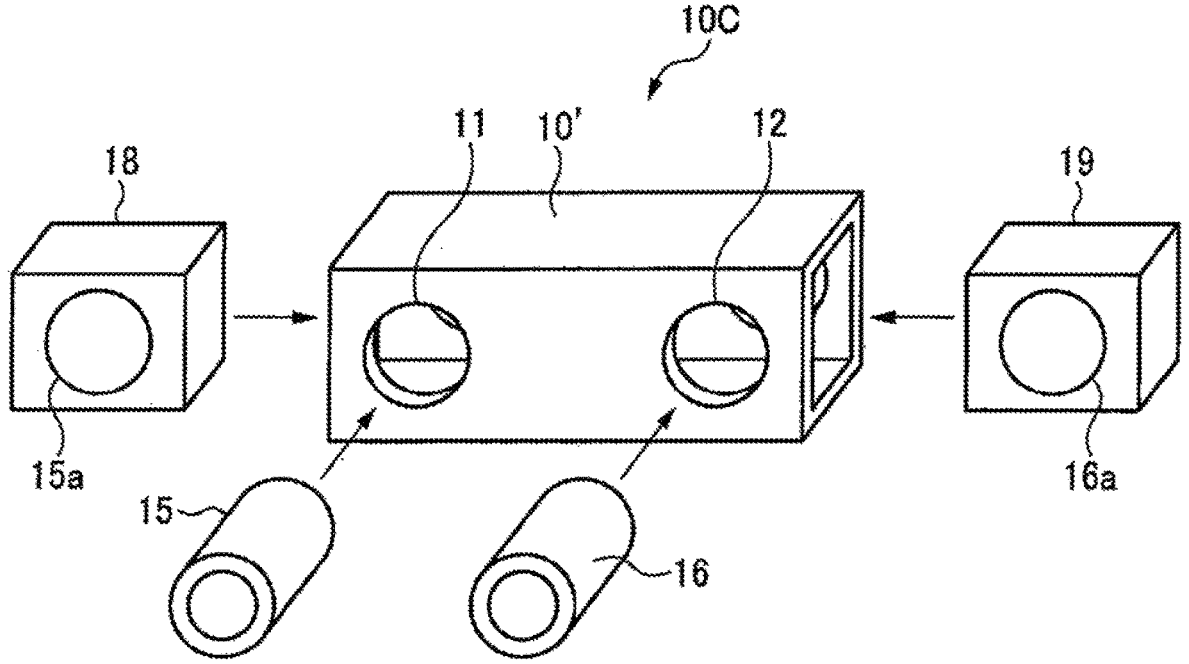
FIG. 6A is an exploded perspective view illustrating the connecting rod provided with the rectangular tubular part made of a fiber-reinforced resin.
Figure 6B:
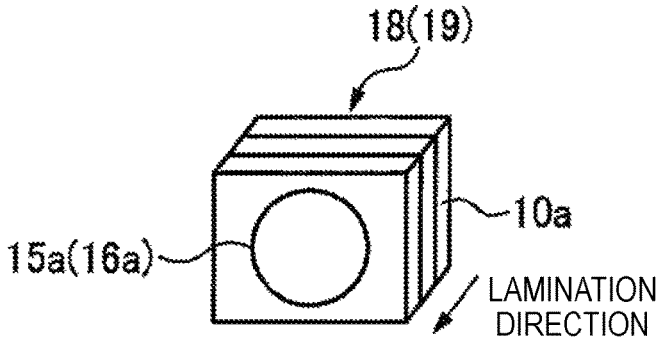
FIGS. 6B and 6C are schematic views for describing the lamination style of the thin plates in the block.
Figure 6C:
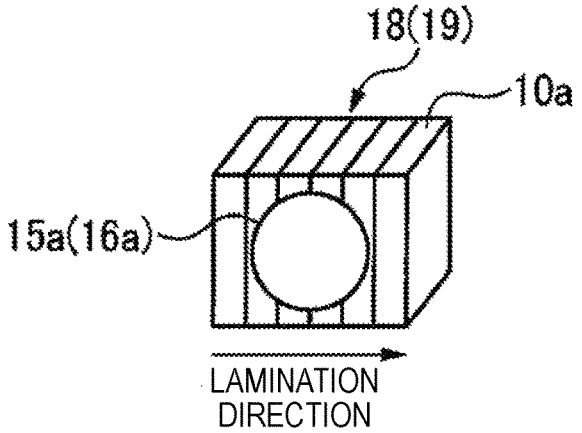

Further, as illustrated in FIGS. 6A to 6C, through holes 15*a* and 16*a* corresponding to the sleeves 15 and 16 may be formed in the blocks 18 and 19. In the connecting rod 10C, in the same manner as that of FIGS. 5A to 5C, the rectangular tubular part 10' made of the fiber-reinforced resin is hollow, and further weight reduction can be achieved in comparison with the connecting rod 10B illustrated in FIG. 4. Further, the connecting rod 10C is reinforced by the blocks 18 and 19, thereby having no problem in consideration of the strength.

The blocks 18 and 19 illustrated in FIG. 6A are formed by laminating the thin plates 10*a*, and a lamination style in which a through hole 15*a* (16*a*) is formed on the end surface (laminated surface) of the laminated thin plates 10*a* as illustrated in FIG. 6C is more desirable than a lamination style in which the through hole 15*a* (16*a*) is formed on the surface of the laminated thin plates 10*a* as illustrated in FIG. 6B. That is, FIG. 6B illustrates a case where the through hole 15*a* (16*a*) is formed along a lamination direction, FIG. 6C illustrates a case where the through hole 15*a* (16*a*) is formed along a direction orthogonal to the lamination direction, and it is desirable that the through hole 15*a* (16*a*) is formed along the direction orthogonal to the lamination direction. In the case of the lamination style illustrated in FIG. 6B, when the openings of the connecting rod 10C are closed with the blocks 18 and 19, the end surfaces of the connecting rod 10 are the laminated surfaces of the thin plates 10*a*. On the other hand, in the case of the lamination style illustrated in FIG. 6C, the end surfaces of the connecting rod 10 are the surfaces of the thin plates 10*a*. In the superfinishing device provided with the oscillating device, the cooling water and the processing oil are often applied to the device, and the thin plate 10*a* made of the fiber-reinforced resin results in the swelling caused by the water absorption and the oil absorption at the thickness portion (the end surface) where the reinforced fiber is exposed. Therefore, when the laminated surfaces of the blocks 18 and 19 are exposed to the end surfaces of the connecting rod 10C as illustrated in FIG. 6B, the end surfaces thereof swell. On the other hand, in FIG. 6C, the end surfaces of the connecting rod 10C are the surfaces of the thin plates 10*a*, and since the laminated surface is surrounded by the rectangular tubular part 10', the swelling of the blocks 18 and 19 can be suppressed.

Further, the surfaces of the connecting rods 10A to 10C can also be coated with a silicone resin as a countermeasure against the swelling caused by the cooling water and the processing oil.

Further, in the same manner as that of the connecting rod 10, the connecting arm 20 also has the through hole (Reference sign 25 in FIG. 1) through which a shaft for being respectively connected to the connecting rod 10 and the connecting shaft 30 is inserted in a rectangular main body portion. Although not illustrated, the connecting arm 20 can be made of the fiber-reinforced resin same as those of the connecting rods 10A to 10C.

Figure 7:
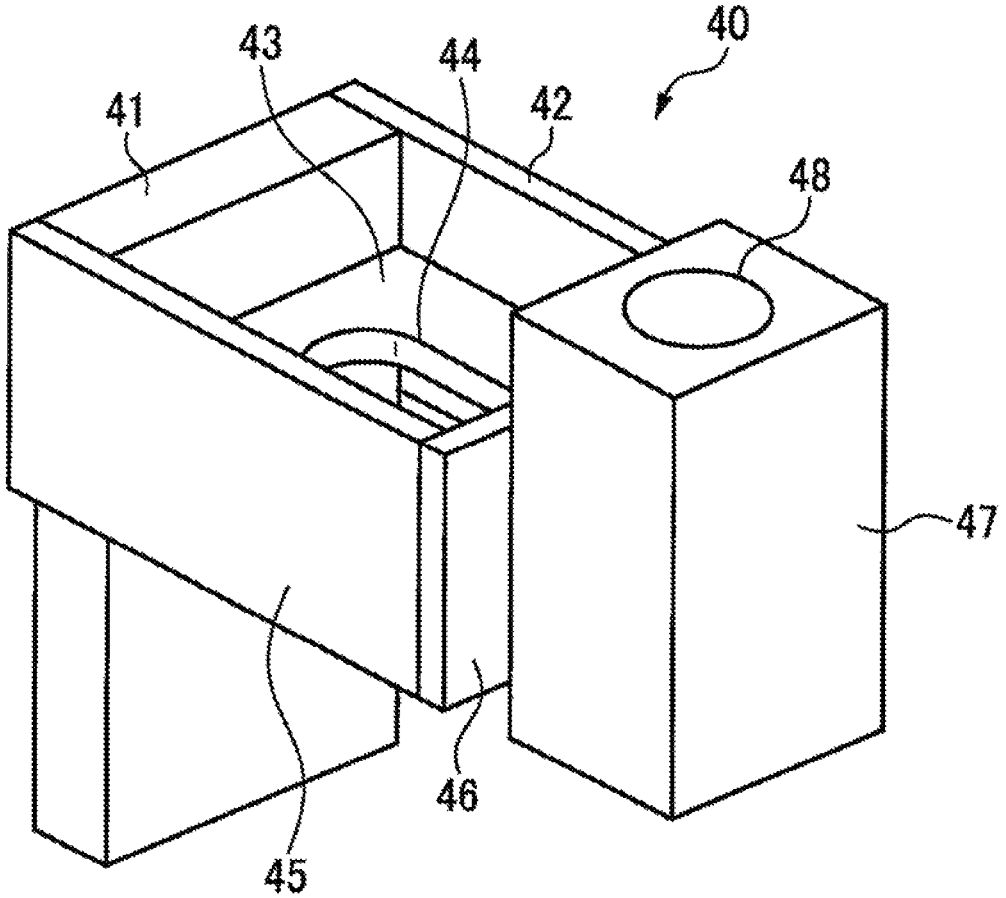
FIG. 7 is a perspective view illustrating a whole structure of a grindstone holder.

Further, the grindstone holder 40 can be made of the fiber-reinforced resin. As illustrated in FIG. 7, the grindstone holder 40 extends first and second arms 42 and 45 from a mounting plate 41 for being mounted on the connecting shaft 30, and the pressurizing cylinder 47 is mounted on the tips of the arms 42 and 45. A block made of the fiber-reinforced resin can be subjected to cutting to be formed into a shape illustrated in the drawing, however, a method, in which respective components such as the mounting plate 41, and the like are formed of a plate material which is made of the fiber-reinforced resin, and are joined with each other with an adhesive, a bolt, and the like, thereby being assembled, is simple and desirable. Further, the plate material is formed by laminating the thin plates, thereby being integrated, and a thickness direction of the plate material is a lamination direction. Further, as illustrated in FIG. 3B, it is desirable that the orientation of the reinforced fiber is also radially oriented outward from the center of the surface.

Figure 8A:
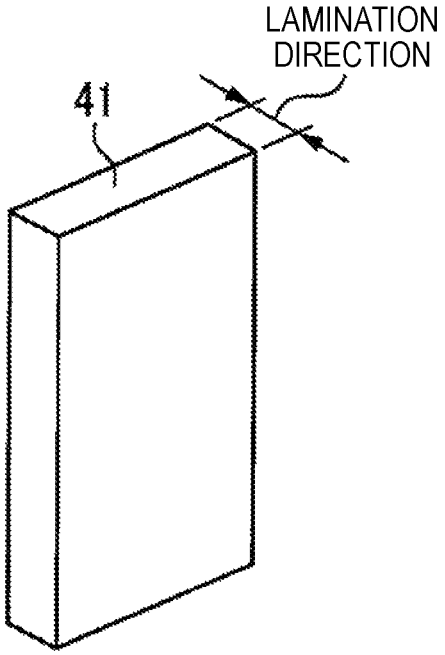
FIGS. 8A to 8E illustrate an assembly view of the grindstone holder in FIG. 7.

FIGS. 8A to 8E illustrate one example of an assembly method, and as illustrated in FIG. 8A, the plate material made of the fiber-reinforced resin is manufactured and cut out into a shape of the mounting plate 41.

Figure 8B:
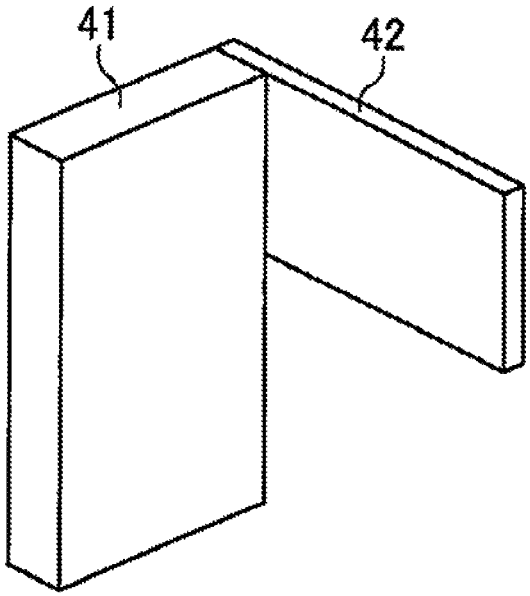

Next, as illustrated in FIG. 8B, the first arm 42 is joined to a plate thickness portion of the mounting plate 41 so as to be perpendicular to the mounting plate 41. The first arm 42 is the plate material made of the fiber-reinforced resin and is cut out into a predetermined shape.

Figure 8C:
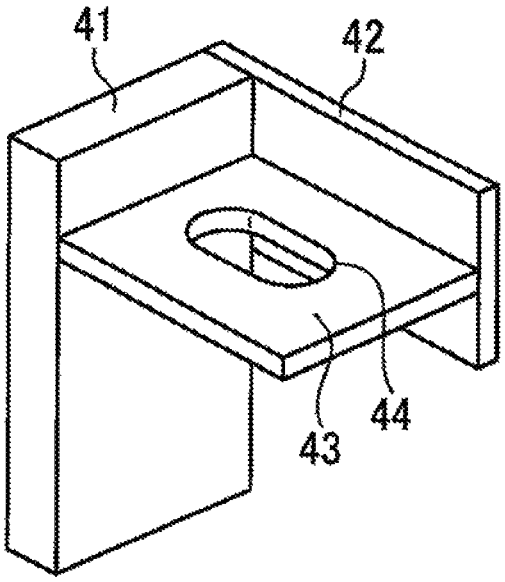

Next, as illustrated in FIG. 8C, a bottom plate 43 is joined to both inner side spaces of the mounting plate 41 and the first arm 42. The bottom plate 43 is the plate material made of the fiber-reinforced resin, and an oil-discharge hole 44 for flowing down and discharging the processing oil is opened at a center part.

Figure 8D:
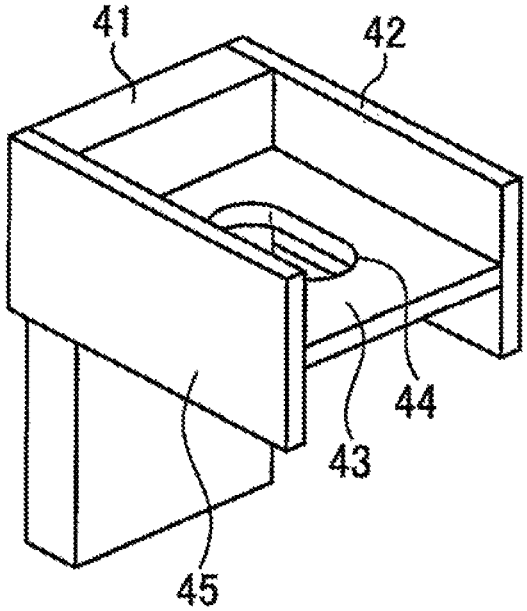

Next, as illustrated in FIG. 8D, the second arm 45 is disposed to be opposite to the first arm 42, and is joined to the mounting plate 41 and the bottom plate 43. The second arm 45 is the plate material made of the fiber-reinforced resin and is cut out into a predetermined shape.

Figure 8E:
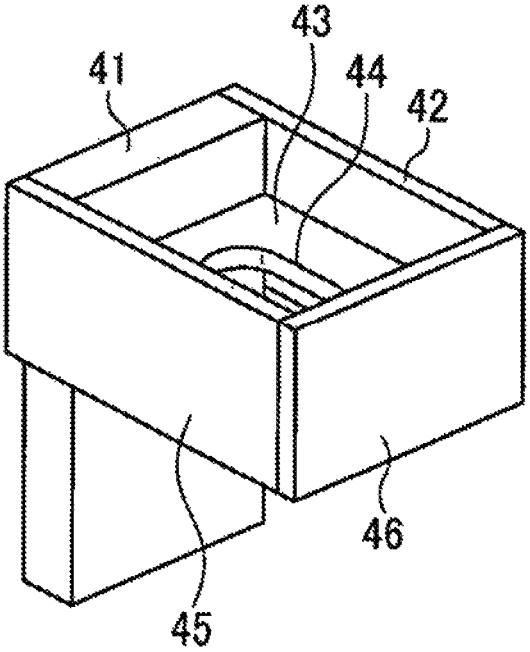

As illustrated in FIG. 8E, a cylinder mounting plate 46 for mounting the pressurizing cylinder 47 is joined to respective tips of the first arm 42, the second arm 45, and the bottom plate 43. The cylinder mounting plate 46 is the plate material made of the fiber-reinforced resin and is cut out into a predetermined shape.

Further, as illustrated in FIG. 7, an insertion hole 48 for inserting a pressurizing piston (not illustrated) is formed in the pressurizing cylinder 47. In the present invention, the pressurizing cylinder 47 can also be made of the fiber-reinforced resin. In this case, the block made of the fiber-reinforced resin may be subjected to cutting, but it is desirable that a plurality of the plate materials made of the fiber-reinforced resin are laminated in an axial direction of the insertion hole 48 to form the insertion hole 48. Further, a sleeve (not illustrated) made of metal such as aluminum, and the like may be fitted into the insertion hole 48.

Figure 9:
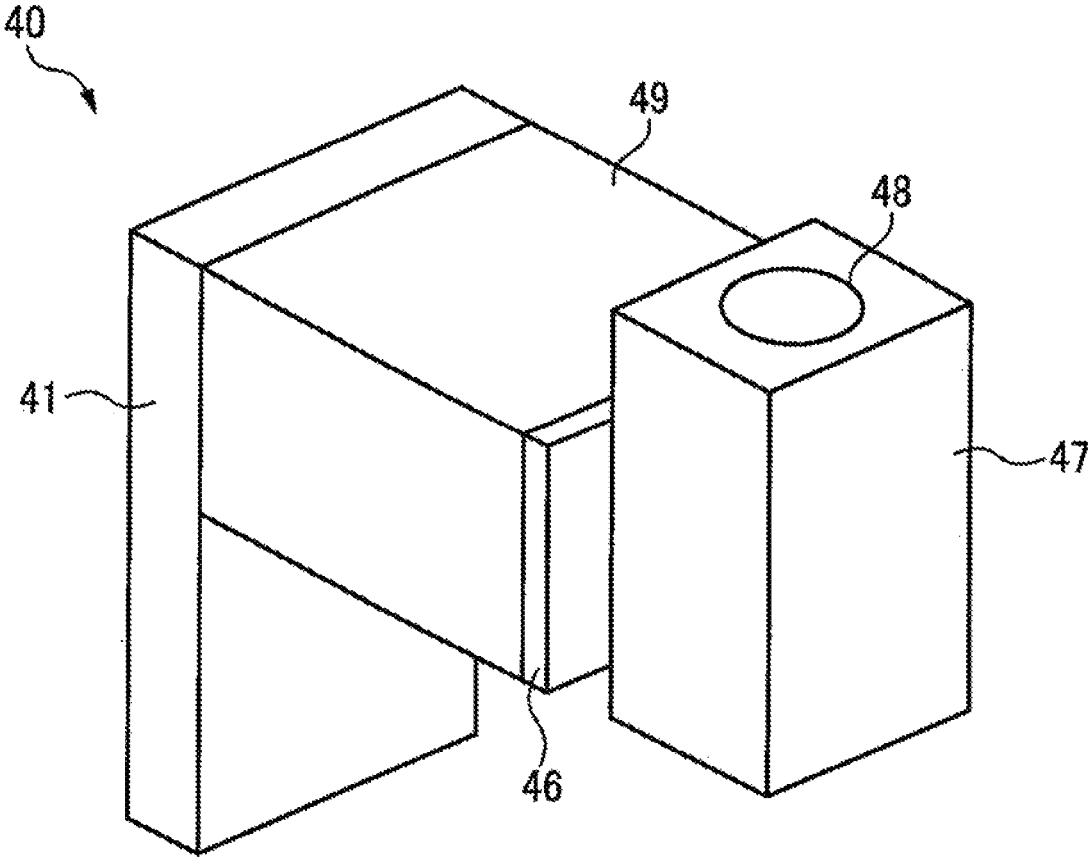
FIG. 9 is a view illustrating another example of a grindstone holder and a perspective view illustrating a whole structure thereof.

The grindstone holder 40 may be formed as illustrated in FIG. 9. The grindstone holder 40 illustrated in FIG. 9 is formed by replacing the first arm 42, the second arm 45, and the bottom plate 43 of the grindstone holder illustrated in FIG. 7 with a tubular body 49. The tubular body 49 is formed by winding a filament made of the reinforced fiber which is impregnated with the binder resin a number of times along the longitudinal direction of the prism-shaped core material, and the binder resin is cured, after which the core material is pulled out and formed into a rectangular tubular shape. Further, the mounting plate 41, the cylinder mounting plate 46, and the pressurizing cylinder 47 are fiber-reinforced resin members same as the grindstone holder 40 illustrated in FIG. 7.

Figure 10A:
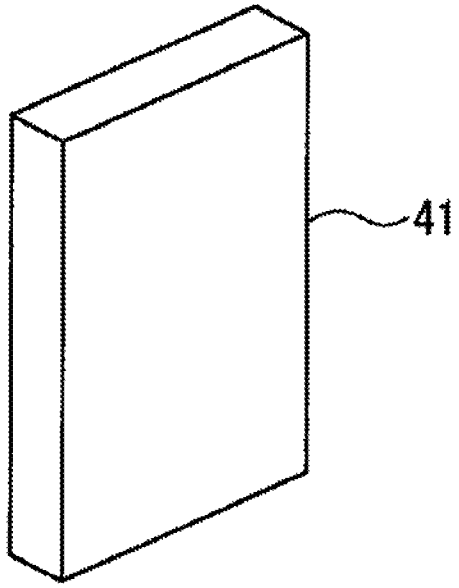
FIGS. 10A to 10C illustrate an assembly view of the grindstone holder in FIG. 9.
Figure 10B:
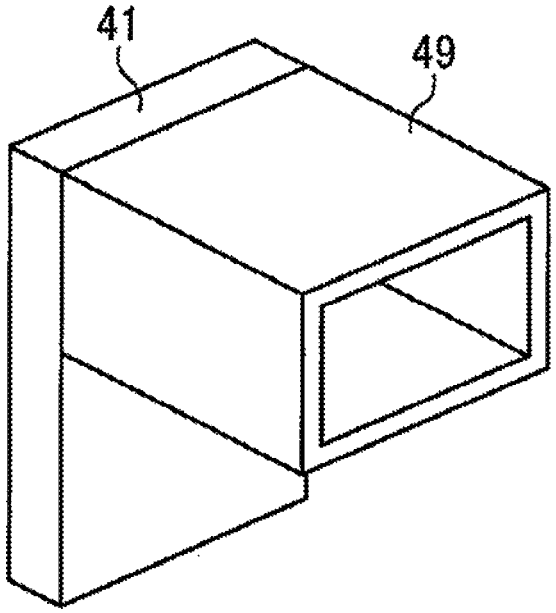
Figure 10C:
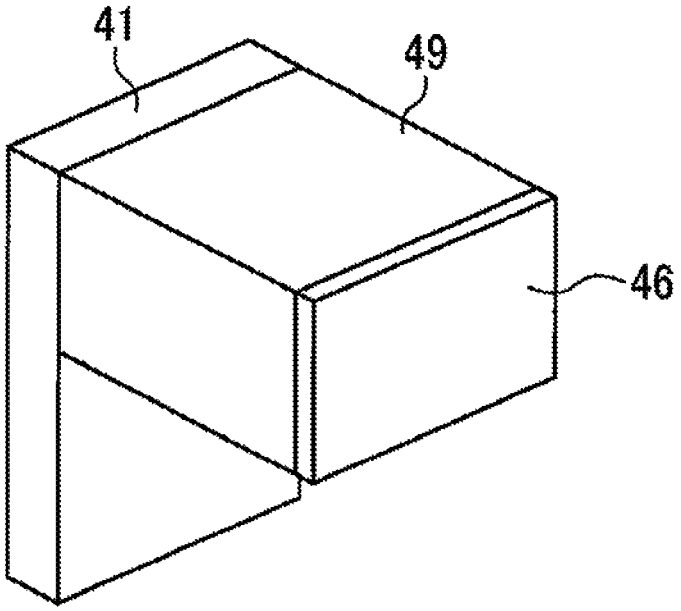

The grindstone holder 40 illustrated in FIG. 9 is assembled as illustrated in FIGS. 10A to 10C. First, as illustrated in FIGS. 10A and 10B, the tubular body 49 is joined to a front surface of the mounting plate 41. After that, as illustrated in FIG. 10C, the cylinder mounting plate 46 is joined so as to close the opening of the tubular body 49. Then, the pressurizing cylinder 47 is mounted on the cylinder mounting plate 46, thereby completing the grindstone holder 40.

Since all of the grindstone holders 40 illustrated in FIGS. 7 and 9 are made of the fiber-reinforced resin members, the grindstone holders are lightweight but have high strength, thereby making it possible to be oscillated at a higher speed and improve process efficiency.

Figure 11:
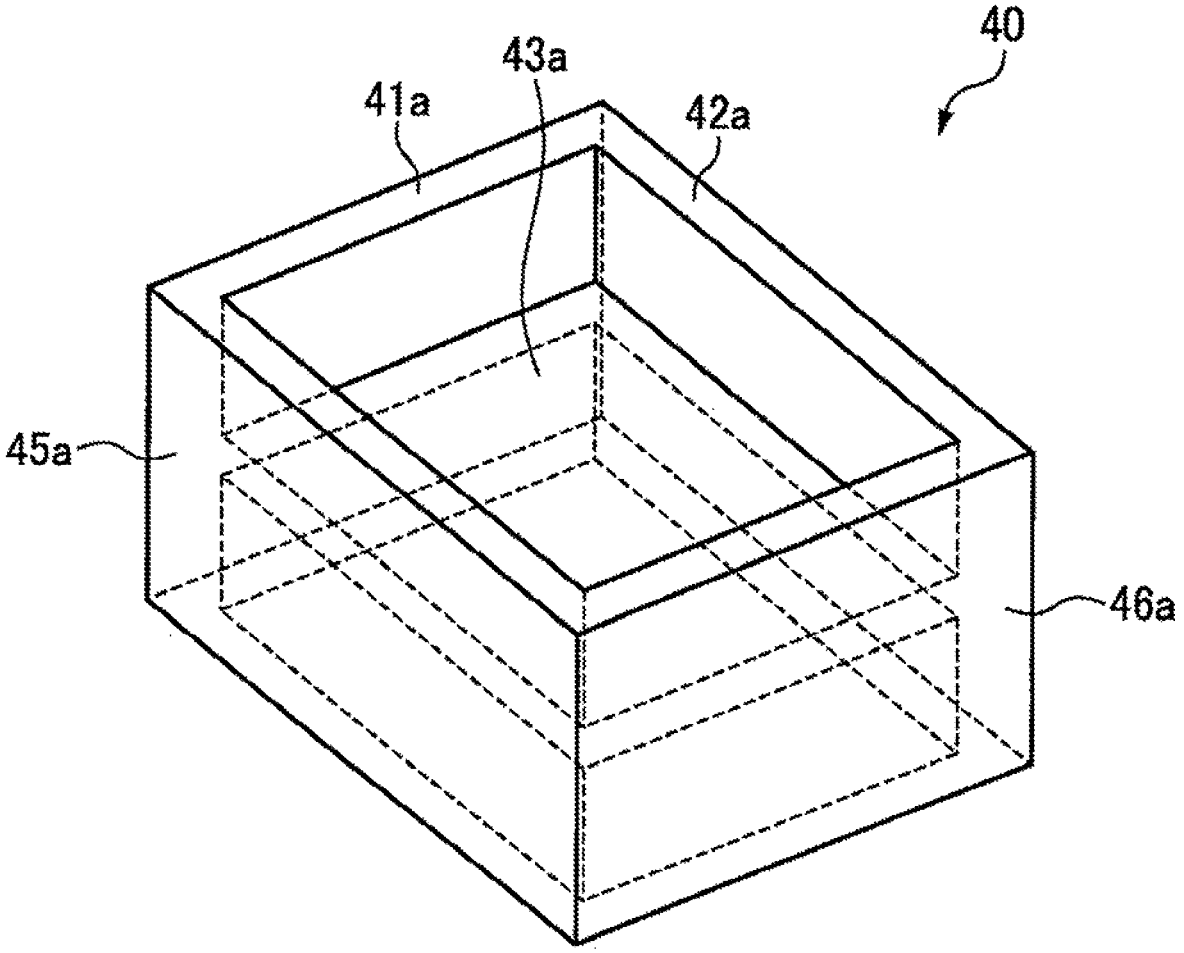
FIG. 11 is a perspective view illustrating another example of a grindstone holder.

Further, the grindstone holders 40 illustrated in FIGS. 7 and 9 are assembled by bonding the plate materials made of the fiber-reinforced resins to each other by using an adhesive, however, since the grindstone holders 40 receive vibration, there exists a concern that the strength may deteriorate at a bonded portion. Therefore, it is desirable to manufacture the grindstone holder 40 by integral molding in order to increase the strength of the bonded portion. For example, as illustrated in FIG. 11, the melt of a resin composition including the reinforced fiber and the binder resin is injected into a mold having a cavity of a shape in which four sides of the bottom plate 43 illustrated in FIGS. 7 to 8E are surrounded by peripheral walls, and then is cured, thereby making it possible to manufacture the integrated grindstone holder 40. In the grindstone holder 40 acquired by the integral molding, as illustrated in the drawings, a horizontal plate 43*a* corresponding to the bottom plate 43 is disposed approximately at a center in a height direction, and a cuboid-shaped space is formed on top and bottom surfaces of the horizontal plate 43*a*, wherein a peripheral wall 41*a* corresponds to the mounting plate 41, a peripheral wall 42*a* corresponds to the first arm 42, a peripheral wall 45*a* corresponds to the second arm 45, and a peripheral wall 46*a* corresponds to the cylinder mounting plate 46 respectively to surround the four sides of the horizontal plate 43*a*.

Figure 12A:
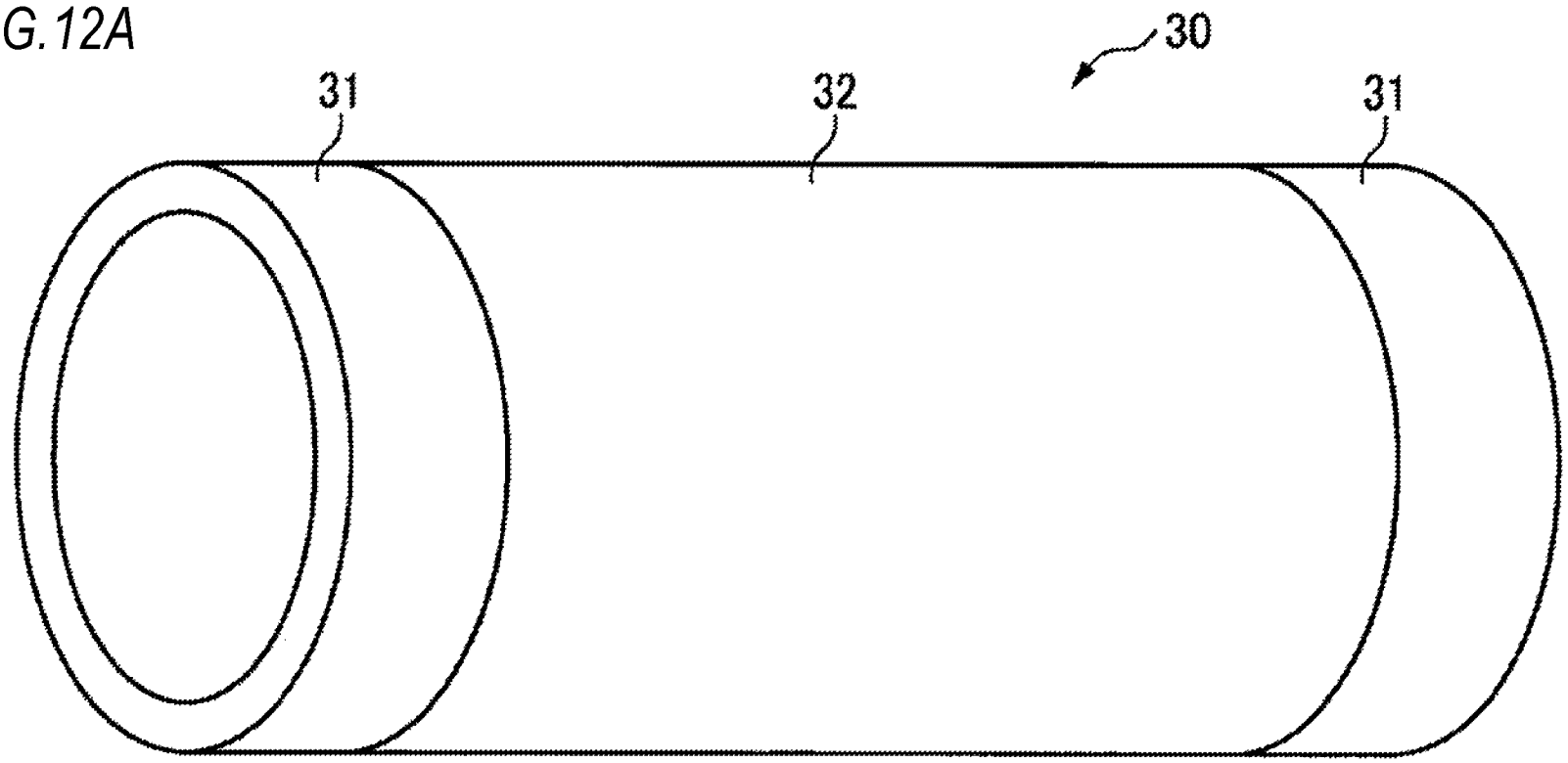
FIG. 12A is a perspective view illustrating one example of a connecting shaft and FIG. 12B is a cross sectional view thereof.
Figure 12B:
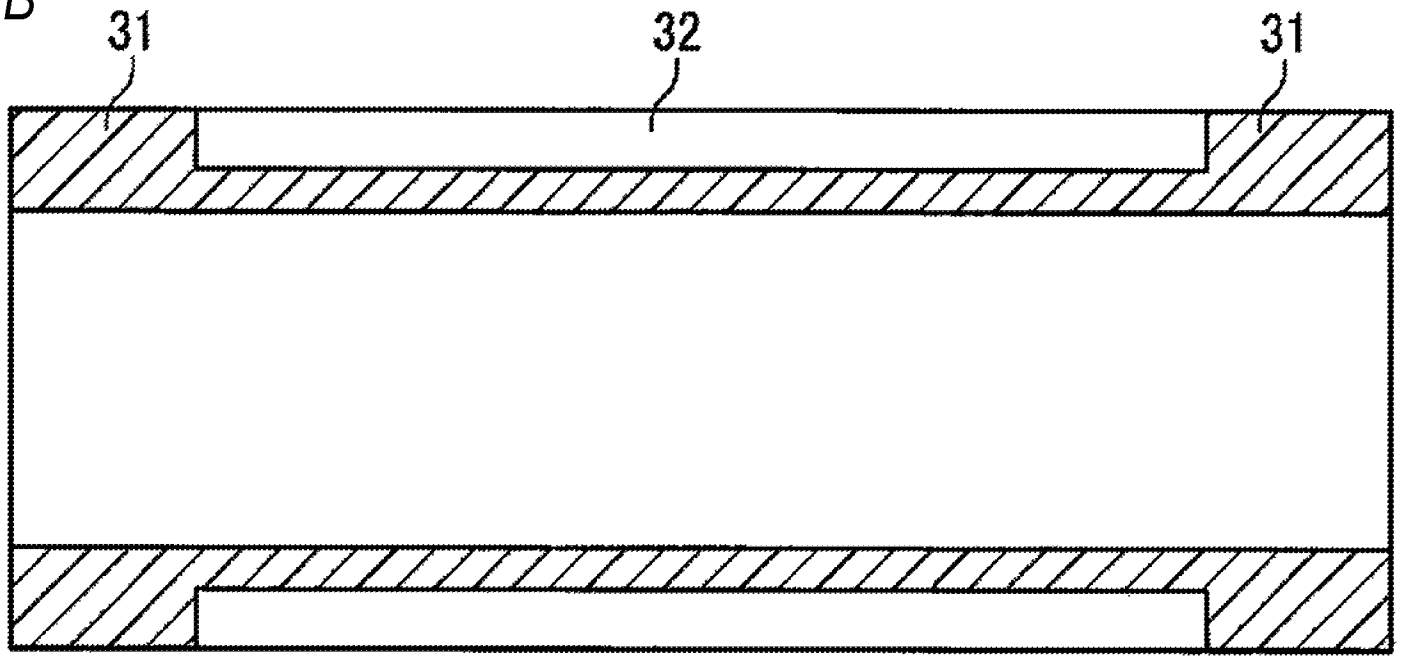

The connecting shaft 30 can be wholly made of the fiber-reinforced resin, however, since the reinforced fiber has insufficient wear resistance, the connecting shaft 30 slides at connecting portions with the connecting arm 20 (refer to FIG. 1) and the mounting plate 41 (refer to FIG. 7) of the grindstone holder 40, and is easily worn out thereat. Here, as illustrated in FIGS. 12A to 13B, opposite ends 31 in a longitudinal direction serving as sliding portions may be made of metal, and a part 32 therebetween may be made of the fiber-reinforced resin. In FIGS. 12A and 12B, a tubular body made of metal is prepared, the opposite ends 31 of the outer peripheral surface thereof are left as long as lengths corresponding to the connecting portions with the connecting arm 20 and the mounting plate 41 of the grindstone holder 40, a recess (Reference sign 32) having the same depth is provided therebetween, and the recess is filled with the reinforced fiber resin. In this case, the tubular body is manufactured by insert molding using a metallic tubular body as a core.

Figure 13A:
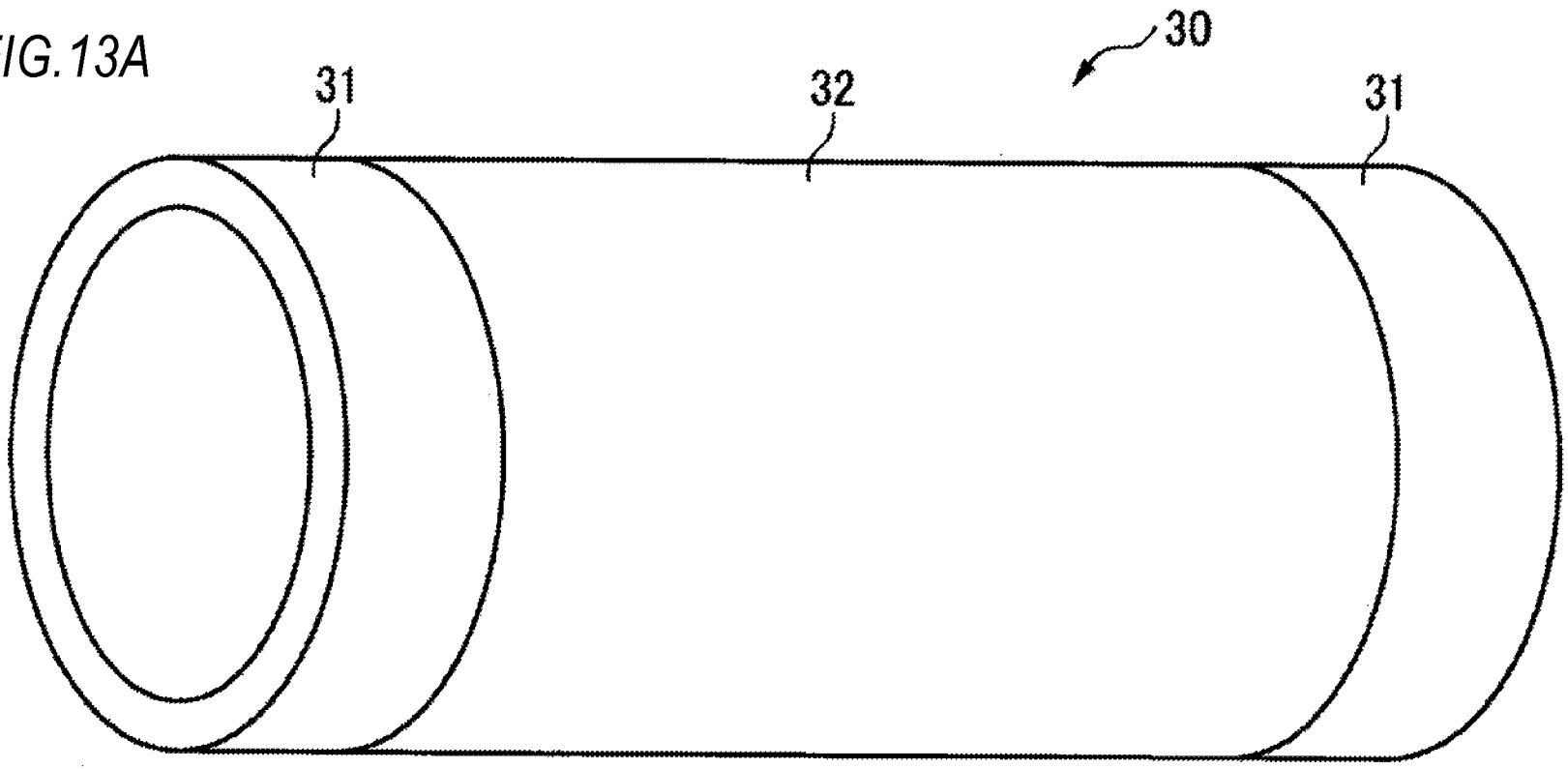
FIG. 13A is a perspective view illustrating another example of a connecting shaft and FIG. 13B is a cross sectional view thereof.
Figure 13B:
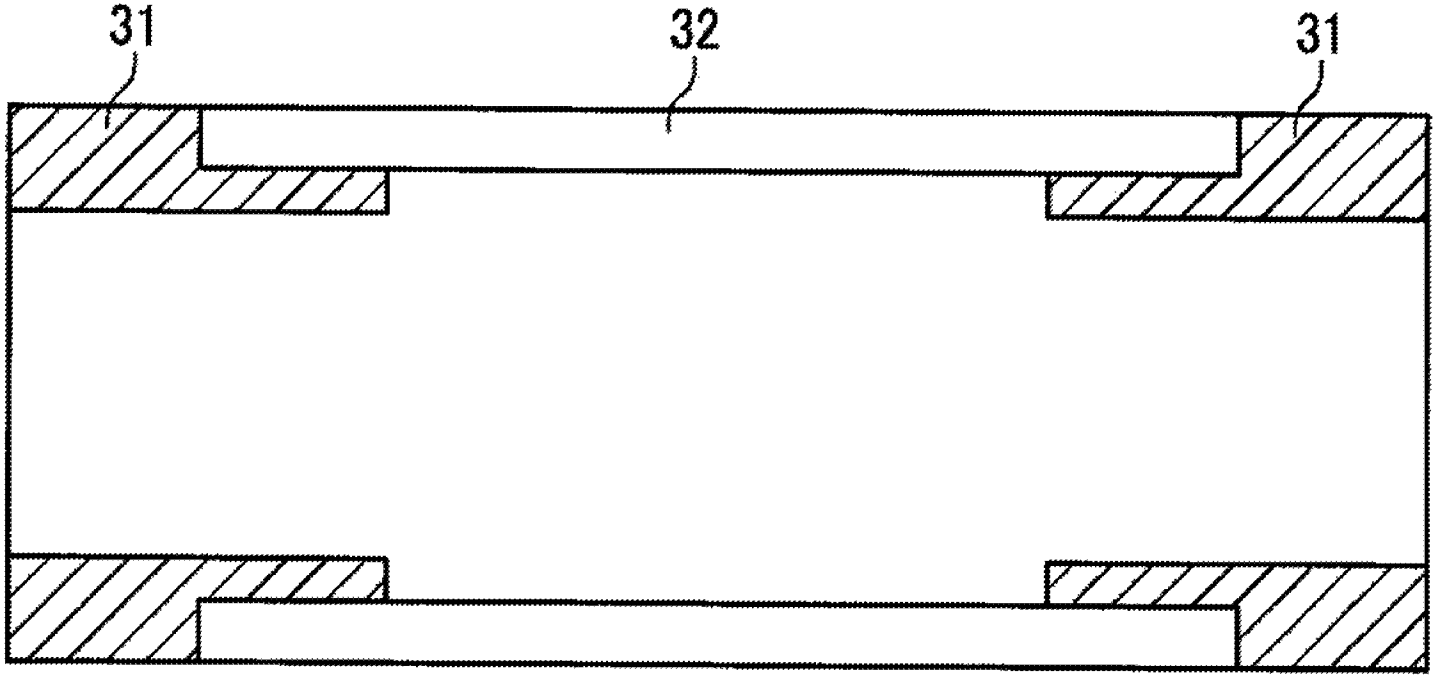

Further, in FIGS. 13A and 13B, annular members (Reference sign 31) made of metal, in which recessed parts matching thickness of a tubular body made of the fiber-reinforced resin are formed on an outer peripheral surface, are fitted to opposite ends of the tubular body made of the fiber-reinforced resin corresponding to the part 32, and are integrated with each other by using an adhesive.

There are no limitations on the reinforced fiber and the binder resin in the fiber-reinforced resin forming the above-mentioned respective members, however, as the reinforced fiber, it is desirable to be lightweight and to have a high tensile strength. For example, a carbon fiber, a polyamide fiber, a boron fiber, a polyarylate fiber, a polyparaphenylene benzoxazole fiber, an ultrahigh molecular weight polyethylene fiber, and the like are suitable, and those fibers can also be mixed with each other and can be used. Particularly, the carbon fiber is desirable. Further, the reinforced fiber may be surface-treated with a sizing agent such as a urethane resin, an epoxy resin, an acrylic resin, a bismaleimide resin, and the like in order to improve adhesiveness with the binder resin.

There is no limitation on an average diameter of the reinforced fiber, but when the reinforced fiber becomes too thin, the strength per one reinforced fiber is not sufficient. On the other hand, when the reinforced fiber becomes too thick, even though the strength per one reinforced fiber is increased, surface properties of a component and a part made of the acquired fiber-reinforced resin deteriorate.

As the binder resin, an epoxy resin, a bismaleimide resin, a polyamide resin, a phenolic resin, and the like can be used, and the binder resin is selected in consideration of the adhesiveness with the reinforced fiber. For example, in the case of the carbon fiber, the epoxy resin can be used. Further, a coating amount of the binder resin or an impregnation amount thereof is not limited, but when the amount of the binder resin is too small, the binding of the reinforced fiber is not sufficient, on the other hand, when the amount of the binder resin is too large, the amount of the fiber is too small, thereby not acquiring the sufficient strength.

In this manner, the oscillating device in which respective parts are made of the fiber-reinforced resin reduces noise as the weight thereof is reduced. In the measurement by a vibration measuring device, a vibration value is reduced in comparison with the oscillating device using metallic components, and noise reduction can be actually realized even in an auditory sense.

Figure 14:
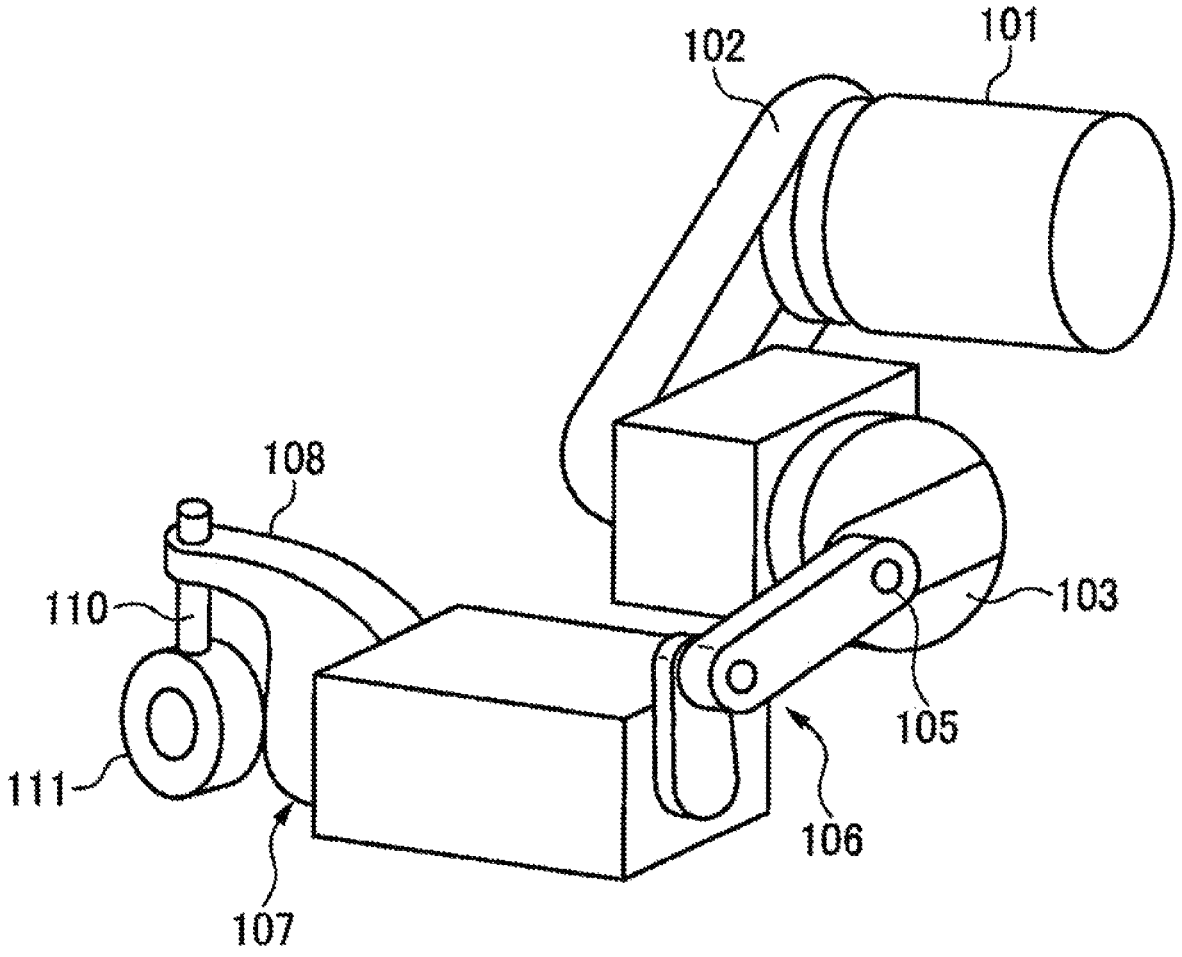
FIG. 14 is a perspective view illustrating a superfinishing device described in PTL 1.

As described above, the exemplary embodiments of the present invention are described, however, the present invention is not basically limited to a type and a configuration of the oscillating device itself and can be applied to various oscillating devices other than the oscillating device illustrated in FIG. 1. Of course, the present invention can also be applied to the oscillating device incorporated in the superfinishing device illustrated in FIG. 14, and for example, the crank 106, and the like can be made of the fiber-reinforced resin.

Further, even in the superfinishing device, the pressurizing piston to be inserted into the insertion hole 48 of the pressurizing cylinder 47 may be integrated by bonding a disk made of the fiber-reinforced resin to upper and lower end surfaces of a cylinder made of the fiber-reinforced resin. Further, the pressurizing lever holder 80 can also be made of the fiber-reinforced resin. It is possible to achieve the weight reduction of the superfinishing device as a whole in addition to the oscillating device by making those components with the fiber-reinforced resin.

The bearing can be manufactured by polishing the raceway surface using the above-mentioned superfinishing device, however, the present invention also includes a method of manufacturing the bearing including such a process of processing a raceway surface as the scope of the present invention.

Further, the present invention also includes a method of manufacturing a vehicle or various machines including manufacturing a bearing by the above-mentioned method of manufacturing the bearing as the scope of the present invention. Further, the machine includes a machine operated by human power as well as electric power.

While the invention has been described in detail with reference to specific embodiments, it will be apparent to these skilled in the art that various changes and modifications may be made without departing from the spirit and scope of the invention. This application is based on JP-A-2017-127207 filed on Jun. 29, 2017, and JP-A-2017-216414 filed on Nov. 9, 2017, the contents of which are incorporated herein by reference.

INDUSTRIAL APPLICABILITY

The present invention is a technology useful for shortening a process time, and further improving productivity of a bearing by reducing the weight of an oscillating device.

REFERENCE SIGNS LIST

1 intermediate shaft spindle
10 connecting rod
11 first through hole
12 second through hole
15, 16 sleeves
18, 19 blocks
20 connecting arm
30 connecting shaft
40 grindstone holder
41 mounting plate
42 first arm
43 bottom plate
44 oil-discharge hole
45 second arm
46 cylinder mounting plate
47 pressurizing cylinder
48 insertion hole
49 tubular body
50 grindstone
60 outer ring
80 pressurizing lever holder
90 pressurizing lever

The invention claimed is:

1. An oscillating device, comprising:
a driving source;
an oscillating member which performs an oscillating motion; and
a connecting mechanism which converts a rotational motion of the driving source into an oscillating motion and transmits the oscillating motion to the oscillating member, wherein:
the connecting mechanism includes a component, and at least a part or whole of the component is made of a fiber-reinforced resin including a reinforced fiber and a binder resin,
the component comprises:
a first through hole for inserting a shaft eccentric to a rotary shaft of the driving source therethrough; and
a second through hole for connecting other components forming the connecting mechanism thereto through another shaft,
the component is formed by binding a wound material of the reinforced fiber with the binder resin, blocks made of the fiber-reinforced resin are inserted into openings at opposite ends of the tubular body to close the openings, and
the first through hole and the second through hole are formed to penetrate through the tubular body and the blocks.

2. The oscillating device according to claim 1, wherein
the component made of a fiber-reinforced resin is an assembly in which plate materials made of a fiber-reinforced resin are combined and bonded to each other.

3. The oscillating device according to claim 2, wherein the plate materials are materials in which the reinforced fiber is radially oriented outward from a center of a surface thereof.

4. The oscillating device according to claim 1, wherein the block is a laminated body formed of thin plates made of a fiber-reinforced resin, and the through hole is formed in a direction orthogonal to a lamination direction.

5. The oscillating device according to claim 1, wherein the connecting mechanism includes a holding component for holding the oscillating member, and the holding component is an assembly in which plate materials made of the fiber-reinforced resin are bonded to each other.

6. The oscillating device according to claim 1, wherein the connecting mechanism includes a holding component for holding the oscillating member, and a part or whole of a component forming the holding component is a tubular body formed by binding a wound material of a filament of the reinforced fiber with the binder resin.

7. The oscillating device according to claim 6, wherein at least a portion of the tubular body where the filament of the reinforced fiber is exposed includes a coating layer made of a silicone resin.

8. A superfinishing device including the oscillating device according to claim 1.

9. A method of manufacturing a bearing, including polishing a raceway surface using the superfinishing device according to claim 1.

10. The method of manufacturing a bearing according to claim 9, wherein the bearing is for use in a vehicle.

11. The method of manufacturing a bearing according to claim 9, wherein the bearing is for use in a machine.

12. An oscillating device, comprising:

a driving source;

an oscillating member which performs an oscillating motion; and a connecting mechanism which converts a rotational motion of the driving source into an oscillating motion and transmits the oscillating motion to the oscillating member, wherein:

the connecting mechanism includes a component, and at least a part or whole of the component is made of a fiber-reinforced resin including a reinforced fiber and a binder resin, the component is provided with a tubular body made of a fiber-reinforced resin, blocks made of a fiber-reinforced resin are respectively inserted into opposite ends of the tubular body, and a space between the blocks inside the tubular body is hollow.

13. The oscillating device according to claim 12, wherein the blocks are formed by laminating thin plates made of the fiber-reinforced resin, and a surface orthogonal to a thickness direction of the thin plates made of a fiber-reinforced resin is arranged in an end surface of the tubular body whose openings are closed by inserting the blocks.

14. The oscillating device according to claim 12, wherein the blocks are formed by laminating thin plates made of the fiber-reinforced resin, and a lamination direction of the thin plates and an inserting direction of the blocks into the tubular body are the same.

15. The oscillating device according to any one of claims 13 to 14, wherein through holes penetrating through the tubular body and the blocks are formed.

16. The oscillating device according to claim 15, wherein metallic sleeves are inserted into the through holes.

17. The oscillating device according to claim 14, wherein a cross section of the tubular body orthogonal to an axial line of the tubular body is a rectangular shape, and the tubular body has a symmetrical shape in a longitudinal direction.

18. The oscillating device according to claim 12, wherein through holes penetrating through the tubular body and the blocks are formed, and each of the blocks is a laminated body formed of thin plates made of a fiber-reinforced resin, and the through holes are formed in a direction orthogonal to a lamination direction of the thin plates.

19. An oscillating device, comprising:

a driving source;

an oscillating member which performs an oscillating motion; and a connecting mechanism which converts a rotational motion of the driving source into an oscillating motion and transmits the oscillating motion to the oscillating member, wherein:

the connecting mechanism includes a component, and at least a part or whole of the component is made of a fiber-reinforced resin including a reinforced fiber and a binder resin, the component is provided with a tubular body made of a fiber-reinforced resin, blocks made of a fiber-reinforced resin are respectively inserted into openings at opposite ends of the tubular body, through holes penetrating through the tubular body and the blocks are formed, the blocks are formed by laminating this plates made of fiber-reinforced resin, and surfaces orthogonal to a thickness direction of the thin plates made of a fiber-reinforced resin are arranged in opposite end surfaces of the tubular body whose openings are closed by inserting the block.

* * * * *